United States Patent [19]

Tubens

[11] Patent Number: 4,981,455

[45] Date of Patent: Jan. 1, 1991

[54] WATER SKI STARTING AID

[76] Inventor: Charles R. Tubens, 6214 NE. Hoyt, Portland, Oreg. 97213

[21] Appl. No.: 282,634

[22] Filed: Dec. 9, 1988

[51] Int. Cl.[5] ..... A63B 69/18; A63C 15/00

[52] U.S. Cl. ..... 441/73; 280/818; 434/253

[58] Field of Search ..... 434/253; 272/97; 441/73, 65; 280/818

[56] References Cited

U.S. PATENT DOCUMENTS

| | | | |
|---|---|---|---|
| 2,959,795 | 11/1960 | Leung | 441/73 |
| 3,066,328 | 12/1962 | Jones | 441/73 |
| 3,125,060 | 3/1964 | Leonard | 441/73 |
| 3,264,663 | 8/1966 | Owens | 441/73 |
| 3,567,239 | 2/1969 | Kitterman | 280/818 |
| 3,626,529 | 12/1971 | Schreck | 441/73 |
| 4,275,904 | 6/1981 | Pedersen | 280/818 |
| 4,293,968 | 10/1981 | Levine | 441/68 |
| 4,460,344 | 7/1984 | Notermann | 441/73 |
| 4,643,444 | 2/1987 | Parkinson | 434/253 |

FOREIGN PATENT DOCUMENTS

| | | | |
|---|---|---|---|
| 3306411 | 8/1984 | Fed. Rep. of Germany | 272/97 |

*Primary Examiner*—Benjamin Layno
*Assistant Examiner*—Sebastiano Passaniti
*Attorney, Agent, or Firm*—Bruce J. Ffitch

[57] ABSTRACT

As an aid for a novice skier, a close fitting fabric glove confines the forward portion of a pair of water-skis. The glove both prevents excessive lateral separation of the skis and maintains a desirable minimum separation—both features greatly assisting a novice, for example, in "getting up" from a deep water start and in his stability when waterborne. The greater planing area of the glove, compared with the ski portions it covers, and its buoyancy (from air entrapment), both help the skier to "get up" more quickly. Flexibility of the fabric of the glove permits substantially normal relative tipping and pitching of the skis for control purposes. The glove is secured to the skis by snap fasteners.

23 Claims, 2 Drawing Sheets

FIG. 7
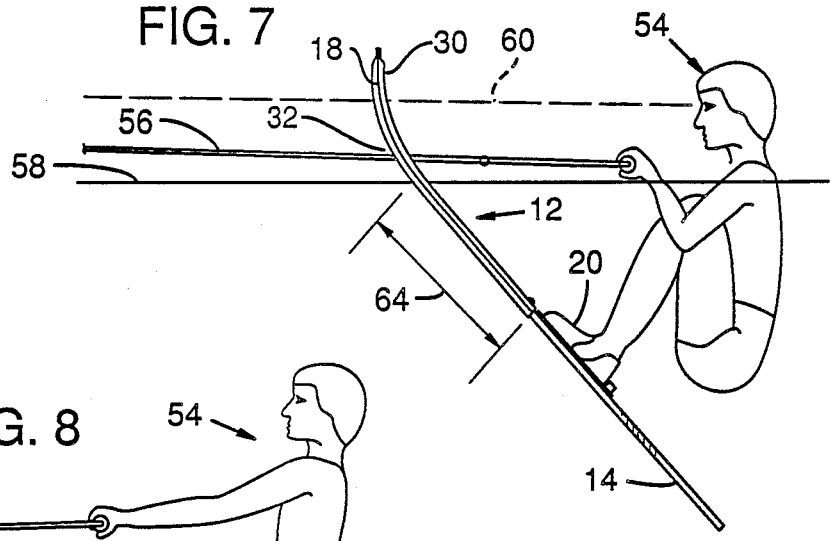
FIG. 8
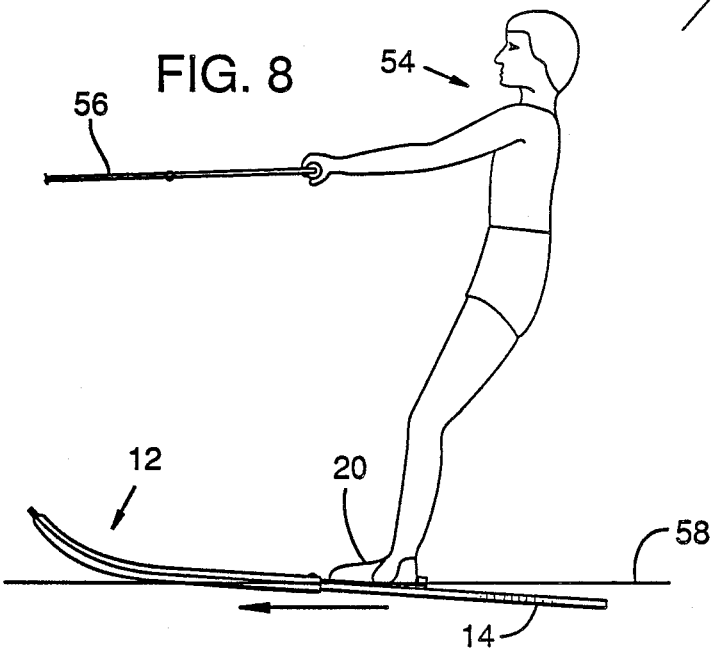
FIG. 9
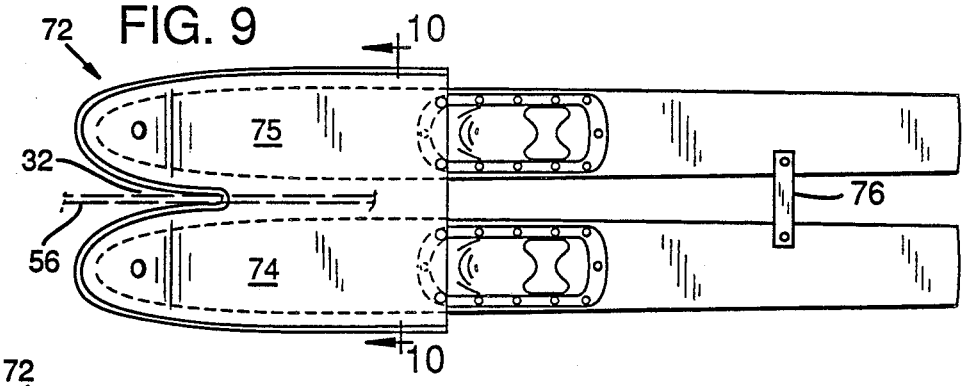
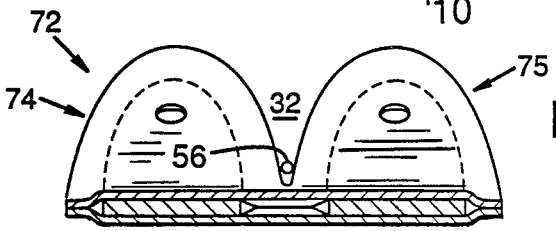
FIG. 10

WATER SKI STARTING AID

BACKGROUND OF THE INVENTION

The invention concerns attachments for water-skis and particularly devices for helping a novice skier control his skis while being accelerated from rest, in a substantially submerged condition, up to planing speed and a substantially upright planing position in which the skis skim the surface of the water.

The transition, in a deep water start, from the stationary semi-submerged condition to the elevated or skiing position is frequently referred to as "getting up". During the period of acceleration the skier must exert himself to maintain the skis in position below his body and at a proper inclination so that, as his speed through the water increases, the skis will elevate and eventually surface. During start up, while the skier is being pulled by the tow boat is "plowing" through the water, there is a tendency for the forward ends of the skis to turn laterally outward drawing the legs of the skier apart so that he is rapidly put into such an awkward unbalanced condition that he capsizes. The novice skier may lack the strength and coordination to overcome the tendency for the skis to separate and find great difficulty in getting waterborne.

A number of devices have been offered to overcome this problem. A common feature of the devices is controlling the lateral spacing of a forward portion of the skis (and sometimes of a rear portion also), while, at least in some cases, permitting some relative lateral tipping and longitudinal pitching of the skis, one relative to the other. While a number of these devices may be generally functionally adequate, they have their several shortcomings. These include: undesirably high weight, cost and complexity; inclusion of hard edges and sharp corners which may injure a skier during a fall or spill; requiring modification of the skis, such as the provision of holes or bosses for mounting; and the inconvenience of mounting and dismounting the devices.

SUMMARY OF THE INVENTION

Accordingly, it is an object of the present invention to provide a water ski starting aid which satisfies not only the basic functional requirement of control of lateral spacing of the skis, but which is also simple in concept, easy and low in cost to manufacture, quickly and easily installed and removed, and which requires no modification of or clamping to the skis.

This object may be realized with a single pliable glove or sock which covers and embraces the forward portions of a pair of skis, fitting closely enough to define a predetermined maximum lateral spacing of the skis, and shaped so as to conform to the ski surfaces and offer a minimum of impedance to forward motion of the skis through the water. The material and structure of the glove is preferably flexible enough to permit relative lateral tipping and longitudinal pitching of the skis sufficient for the skier to maintain stability and control of direction.

In a preferred form of the invention the glove provides a separate sheath or compartment for each ski, so that the glove consists of two elongated side-by-side glove portions. These portions may be connected by a connecting means which in part defines a minimum lateral spacing as well as preventing lateral separation of the skis. The connecting means may also, web-like, substantially fill the longitudinally extending gap between the two side-by-side glove portions, so that the surface area offered to the water by the underside of the glove is effectively increased compared with the corresponding area normally presented by the skis themselves. This "planing" surface may also be effectively increased by the necessary and/or designed extension of the periphery of the glove, outwards from the outer edges of the skis. This effective increase in the planing surface offered by the forward portion of the skis may significantly increase the helpfulness of the glove to a beginning skier in his attempts to reach a proper skiing position.

In a second embodiment a glove or sock which laterally spans and confines a forward portion of both members of a pair of skis is not divided into side-by-side pockets as in the preferred embodiment just described. This simpler form retains many of the advantages of the preferred embodiment. If desired, both versions may be used with a strap or tie coupling the rearward portions of the skis so as to provide additional control of lateral spacing.

It is a feature of the invention that a glove of given size may fit a range of ski lengths and widths without adjustment of the device and without modification of, or attachment to the skis and without marring of the ski surfaces.

An advantage of a glove according to the invention is that it may be of a soft and pliable material offering little risk of injury to the skier in the case of impact during an upset. Such a material may make the device easy to fold and thus compact, convenient for carrying and for storage.

Another feature of the invention is that, due to the entrapment of air within the glove, it is inherently buoyant, which also enhances its effectiveness as a training aid. This buoyancy may be controlled at a desired level by, for example, the provision of vent holes in the glove.

The above and other features and advantages of the invention will be evident from the description and claims which follow.

BRIEF DESCRIPTION OF THE DRAWINGS

FIG. 7 illustrates a skier with a pair of skis equipped with a glove according to the invention, at an early stage in a deep water start.

FIG. 8 shows the skier with the skis in planing position after a successful start up.

FIG. 9 is a view similar to FIG. 1 of a second embodiment of the invention.

FIG. 10 is a view similar to FIG. 2 of the second embodiment.

DESCRIPTION OF THE PREFERRED EMBODIMENTS

Figure 1:
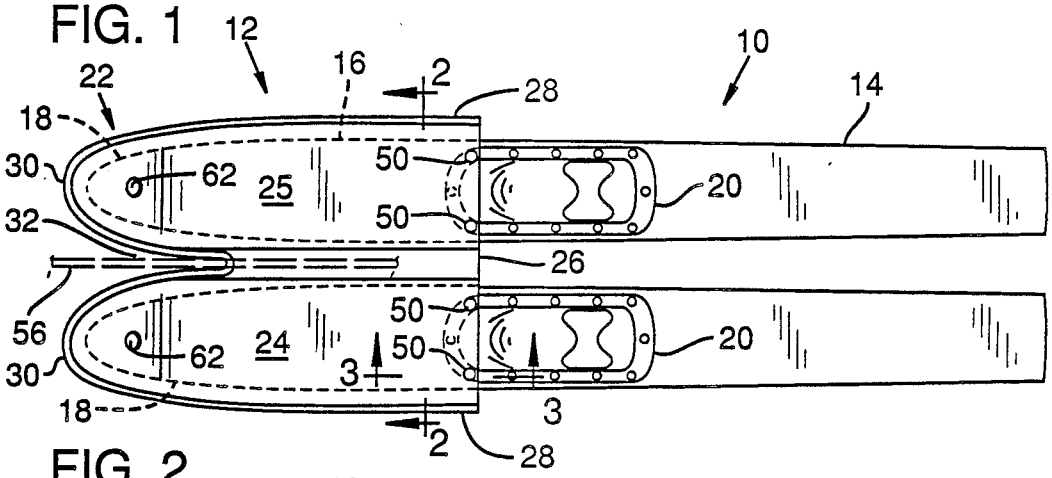
FIG. 1 is an overhead view of a pair of water-skis with a glove according to the invention in position on a forward part of the skis.
Figure 2:
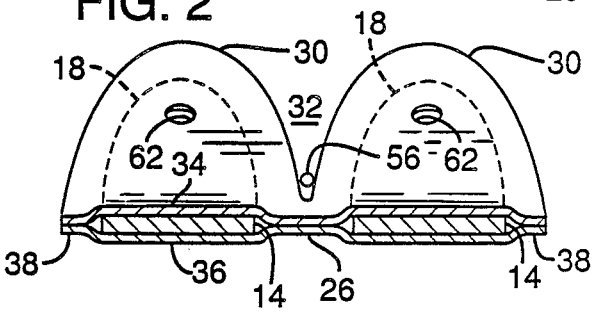
FIG. 2 is an enlarged cross-sectional view taken approximately on line 2—2 of FIG. 1.

FIG. 1 shows a pair of conventional water-skis 10 in parallel spaced apart, side-by-side relationship, as in typical operation and with a training glove or sock 12 according to the invention in position on the skis. Each ski 14 includes a forward portion 16 with a turned up tip 18 and a conventional foot binding 20, approximately midway along its length.

The glove body 22 is made up of a pair of side-by-side compartment portions 24, 25 joined by a web-like connector or divider 26. Each compartment portion 24 includes a substantially rectangular rear portion 28 and a tapered forward portion 30. The tapering of the tip portions 30 of the glove defines a relatively deep V-notch or bight 32 between them.

In the form of construction of the glove 12 shown here, upper and lower sheets or walls 34, 36 are used. These are brought together and attached, by some suitable method such as gluing or stiching, on the longitudinal center line to form the connector 26, and around the outer sides and tip peripheries to form an outer seam 38. The free rear edges of the sheets 40, 42 respectively, define openings 44 to the compartments of the glove so defined.

Figure 4:
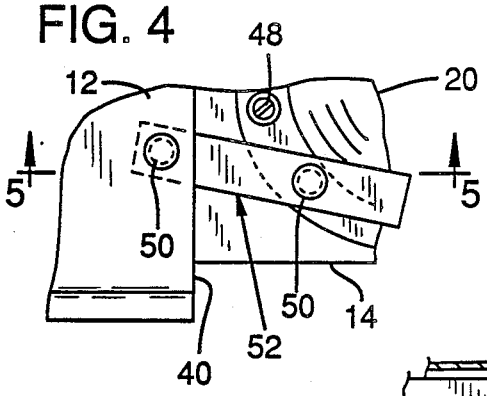
FIG. 4 is a partial overhead view illustrating a variation of the means for securing the glove to the skis.
Figure 3:
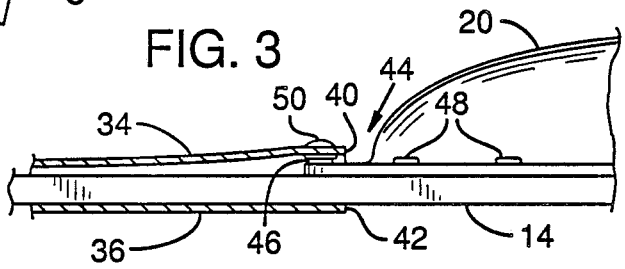
FIG. 3 is an enlarged, partial cross sectional view taken approximately on line 3—3 of FIG. 1, and showing a means of securing the glove to the skis.
Figure 5:
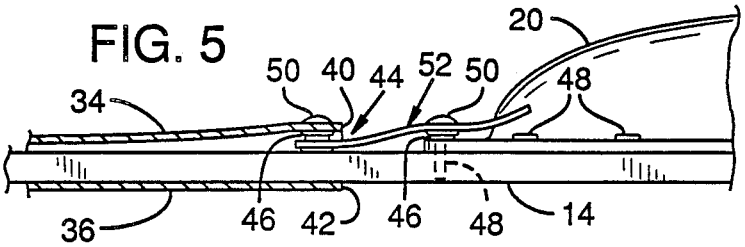
FIG. 5 is an partial cross-sectional view taken approximately on line 5—5 of FIG. 4.

To prevent the glove 12 from slipping forward on the skis, suitable fastening devices such as snap fasteners may be used. As shown in FIGS. 3 and 5 a male snap fastener 46 may be secured to the ski making use of one of the attaching screws 48 of the foot binding 20. Mating female snap portions 50 are secured in the upper sheet 34 of the glove, close to its rear edge 40. In the example of FIG. 1 four such snap fasteners are used and there is a direct connection between the glove and the ski. Where necessary an extender strap 52 may be used to reach from the glove to a convenient binding attaching screw 48 as shown in FIGS. 4 and 5. To accommodate varying fits between glove and ski the extender strap 52 may have one or more snap members 46, 50 at each end, but only one of each is shown in the drawings.

In operation, the skis 14 are positioned in the glove 12 as shown in FIG. 1 and secured by snap fasteners 46, 50. The skier 54, grasping the tow rope 56 and with feet in the bindings 20, positions himself for a deep water start, approximately as shown in FIG. 7. The ski tips 18 are elevated above the water surface 58, and covered of course by the glove 12. As indicated in FIG. 7, the bight or notch 32 between the glove tips 30 provides clearance for the tow rope 56 and also a "window" for the line of sight 60 between the skier 54 and the tow boat (not shown).

Attaining the position shown in FIG. 7 is assisted by the buoyancy of the forward portions 16 of the skis produced by air which tends to be trapped within the compartments 24 of the glove 12. This buoyancy may be moderated, if necessary, by air vents 62 appropriately positioned as, for example, shown in FIG. 6. These same vents 62 may also assit in draining water from the glove.

Another element of the help given to the beginning skier by a device according to the invention is an increase in the effective planing area of the forward portion of the skis which potentially enables the skier to get up more quickly. The longitudinal extent of this planing surface is indicated at 64 in FIG. 7. This longitudinal extend obviously would be the same, with or without the glove 12. However, the increased area comes from the filling of the gap between the skis by the connector portion 26 and by the effective width extension provided by the seams 38 at the outer edges of the skis or the extra material of an "oversized" glove. If a solid connector 26 is used as in the present embodiment, it also acts as a screen to reduce the amount of spray directed into the face of the skier.

It is of particular help to the novice water skier that the glove 12 substantially holds the skis together and at a suitable lateral spacing for him. The positive planing effect of the glove leaves him free to concentrate on finding his balance in an upright fore and aft plane while the control of the skis by the glove helps him maintain lateral stability.

"Getting up" with a slow or underpowered tow boat and using only conventional skis may be uncomfortably prolonged. The positive effects of the glove, including control of ski alignment and particularly of planing surface enhancement and increased buoyancy, may considerably shorten the process. And in the early stages of getting up, with any boat, the tow rope passing through the notch 32 helps the skier maintain directional control. If the skier veers to left or right, the pressure of the tow rope engaging one or the other side of the notch 32 tends to realign skis and skier with the direction of the tow rope.

Figure 6:
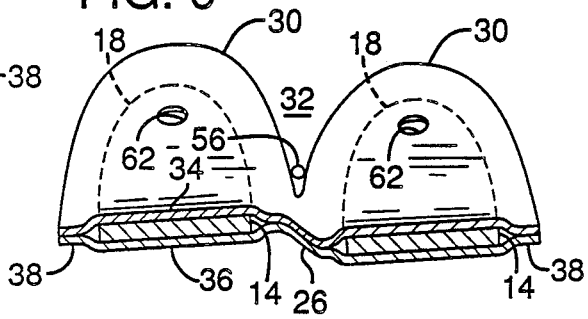
FIG. 6 is a view similar to FIG. 2 illustrating a deflection of the glove which may take place during operation.

Once up, with the skis in planing attitude as shown in FIG. 8, the presence of the glove 12 makes only a small modification in ski performance. As can be seen in FIG. 8 the glove conforms closely to the profile of the forward portion of the skis and offers little impedance to ski movement through the water. Preferably, the material of the glove is sufficiently flexible to permit some tipping of the skis for control, as indicated in FIG. 6, or for relative pitching movement between the skis. (Not shown in the drawings.)

It will be apparent that, within the scope of the invention, a water-ski training glove may be made from a wide variety of materials and (when made from more than one piece) its component pieces joined by any one of a number of suitable methods. For example, an automotive or marine type vinyl upholstery fabric with woven polyester backing has been used successfully. Edge seams 38 and connector portion 26 were joined using an adhesive such as a urethane rubber compound (for example, that sold under the trademark AQUA-SEAL. When the glove is suitably reinforced, for example at the base of the notch 32 and around the snap fasteners 50, a glove made of this material has been found to be durable and able to withstand the stresses of repeated falls by a skier. Vinyl material with a nominal thickness of ⅛th inch has worked satisfactorily. An advantage of the vinyl material is that a glove made from it floats if it becomes detached from the skis. Air inclusions in this fabric make the material itself buoyant.

One size of glove may fit a range of ski sizes. Practical and useful exemplary dimensions for a glove have been found to be 27 inches in overall length, 20 inches overall width with the V-notch or bight 32 extending approximately 12 inches from the forward extremity of the tip 30 of the glove. Preferably, the connector 26 should be proportioned so as to maintain a lateral spacing between the skis of not less than about 4–6 inches.

Although the simple form of a glove according to the invention adapts it to accommodating a range of ski sizes, a relatively snug fit between the glove and the skis is preferable. The glove may longitudinally partially overlap the ski binding 20, thus embracing almost half the length of the ski. Preferably, the rear portion of each glove compartment 28 is parallel sided (rectangular), and each compartment fits its ski closely enough so that, not only is the main object of the glove (controlling the forward portion of the skis) achieved, but the spreading of the rear portion of the skis is also limited. Some limited amount of lateral separation between the skis is necessary to assist the skier in maintaining lateral stability.

In the embodiment of FIGS. 9 and 10, internal longitudinal division of the glove 72 has been dispensed with but, of course, the two halves 74, 75 are still connected so that the external form of the glove is essentially similar to that of the first embodiment (as indicated in FIGS. 1 and 9). It therefore retains the advantages that derive from this form. These include an increase in effective planing area and maintaining control of the forward portions of the skis. With both embodiments, if desired, supplemental control of the trailing ends of the skis can be obtained by using a tie or straps, such as tie 76 shown in FIG. 9, attached by any suitable method to the skis, preferably towards their trailing ends.

As can be seen from the drawings and above description, a water-ski training glove according to the invention may be of simple construction and potentially low in manufacturing cost. In operation it is unobtrusive and may be made from any one of a number of soft or smooth materials, presenting little risk of injury to a falling skier who may come into contact with the glove. Such gloves may be light in weight and easily folded for convenience in carrying or storage.

I claim:

1. A water-ski training combination providing control of the relative side-by-side juxtaposition of a pair of water-skis and increasing the effective planing surface of a forward portion of the skis so as to assist a skier connected to a forward moving boat by a tow rope in making the transition, in a deep water start, from a semi-submerged condition to an elevated skiing position and in which transition the skier relies on the upward force resulting from the flow of water against the effective planing surface during forward motion of the skier to elevate him, comprising:

a pair of elongated water-skis, laterally spaced, each ski having a width and an overall length and a forward portion including a ski tip and an undersurface, the undersurfaces together defining the effective planing surface; and a flexible closed glove, having a forward end and upper and lower walls, for substantially enclosing and confining the forward portions of the skis and extending rearwardly from the ski tips so that the lower wall underlies not less than about one-third of the overall length of the skis and laterally spans the widths of the skis and the space between the skis so as to, in operation, facilitate maintaining the skis in parallel side-by-side spaced apart relationship, and so as to limit lateral separation of the skis while permitting some relative movement between the skis and so as to substantially increase the effective planing surface available for facilitating the transition of the skier from a deep water start to the elevated skiing position.

2. The training combination of claim 1 wherein at least a forward portion of the glove is bifurcated into two compartments and each compartment receives the tip of a ski.

3. The training combination of claim 2 wherein the bifurcation extends substantially the full length of the glove.

4. The training combination of claim 2 wherein the bifurcation is created, at least in part, by directly joining the upper and lower walls together to form a divider portion.

5. The training combination of claim 4 wherein the divider portion establishes a minimum lateral separation of the skis.

6. The training combination of claim 1 wherein the glove is made from a pliable material so that in operation at least some tipping and pitching of the skis, one relative to the other, is possible.

7. The training combination of claim 1 wherein the glove is made from a flexible material so that in operation at least some tipping and pitching of the skis, one relative to the other, is possible.

8. The training combination of claim 1 wherein the glove is made substantially from a fabric material.

9. The training combination of claim 1 wherein the glove is substantially closed except for a generally rearwardly directed opening for permitting entry of each ski and wherein, in operation, the opening is directed rearwardly and downwardly so that any air entrapped in the glove establishes a buoyancy of the glove, and including at least one vent disposed towards the forward end of the glove for venting air from the glove to modify the buoyancy.

10. The training combination of claim 1 wherein a forward portion of the glove includes a pair of side-by-side tip receiving recesses, each for receiving the tip of a ski, the recesses being shaped and sized so that, in operation, the lateral separation of forward portions of the skis is maintained in a predetermined range.

11. The training combination of claim 1 and including means connected between the skis, generally rearwardly of the glove, for providing control of lateral separation of the skis supplementary to that provided by the glove.

12. The training combination of claim 1 wherein the forward end of the glove includes a contoured forward edge traversing the tips of the skis, said forward edge being contoured so as to define a V-notch in the forward edge, the notch having a depth and extending rearwardly between the tips of the skis.

13. The training combination of claim 12 wherein the depth of the V-notch is not less than about 10 inches.

14. A water ski training aid for use in combination with a pair of water skis, for assisting a beginning skier comprising:

first and second elongated sheaths, each sheath having a substantially closed forward toe end and an opposite open end, and sized to receive the forward portion of a ski; and means connecting the sheaths for maintaining them in substantially parallel side-by-side alignment so that in operation, with a pair of skis received into the respective sheaths, the freedom of the skis to diverge laterally is restrained and wherein the connecting means has forward and rearward ends and the forward end is spaced rearwardly of the toe portions of the sheaths so that in operation, before the skier is up, a forwardly and upwardly open viewing aperture may be defined between the toe portions of the sheaths and above the connecting means, for visual communication between a tow boat and the skier.

15. The training aid of claim 14 wherein the connecting means is flexible.

16. The training aid of claim 14 wherein, in operation, the connecting means is effective to maintain a lateral separation between the skis not smaller than a predetermined minimum.

17. The training aid of claim 14 wherein the sheaths are made from a first material and the connecting means is made from a second material, and the first and second materials have similar material properties.

18. The training aid of claim 17 wherein the structure of the training aid consists essentially of unitary upper and unitary lower fabric sheets, said sheets together comprising the first and second sheaths and the connecting means.

19. The training aid of claim 18 wherein the connecting means is defined by localized attachment of the upper and lower fabric sheets into a fixed relationship, said localized attachment defining the inner edges of the sheaths.

20. The training means of claim 14 wherein each sheath is tapered so as to be narrower at the toe portion than in the rear portion.

21. The training aid of claim 14 and including means for releasably retaining the training aid on the skis.

22. The training aid of claim 14 wherein the viewing aperture has a fore and aft extent and said extent is not less than about 10 inches.

23. The training aid of claim 14 wherein the water skis carry foot bindings intermediate the ends of the skis and wherein, in operation, the open ends of the sheaths are adjacent the foot bindings.

* * * * *